US006271792B1

(12) United States Patent
Sletten et al.

(10) Patent No.: US 6,271,792 B1
(45) **Date of Patent: *Aug. 7, 2001**

(54) LOW COST REDUCED-LOSS PRINTED PATCH PLANAR ARRAY ANTENNA

(75) Inventors: Robert John Sletten, Bow, NH (US); Eric Andrew Soshea, Westminster, MA (US); Walter Leo Storkus, Canton, MA (US); Bernhard A. Ziegner, Tyngsboro, MA (US)

(73) Assignee: The Whitaker Corp., Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/910,347

(22) Filed: Jul. 24, 1997

Related U.S. Application Data

(60) Provisional application No. 60/022,621, filed on Jul. 26, 1996.

(51) Int. Cl.[7] ..... H01Q 1/38
(52) U.S. Cl. ..... 343/700 MS
(58) Field of Search ..... 343/700 MS; H01Q 1/38

(56) References Cited

U.S. PATENT DOCUMENTS 5,115,217 * 5/1992 McGrath et al. ..... 343/700 MS
5,155,493 * 10/1992 Thursby et al. ..... 343/700 MS
5,227,749 * 7/1993 Raguenet et al. ..... 343/700 MS
5,444,453 * 8/1995 Lalezari ..... 343/700 MS
5,497,164 * 3/1996 Croq ..... 343/700 MS
5,583,376 * 12/1996 Sickler et al. ..... 257/702
5,661,494 * 8/1997 Bondyopadhyay ..... 343/700 MS
5,712,644 1/1998 Kolak ..... 343/700 MS
5,825,334 * 10/1998 Gherardini et al. ..... 343/700 MS

OTHER PUBLICATIONS

Periodical IEEE Transactions on Microwave Theory and Techniques, Apr. 1968, author Eikichi Yamashita, et al., Title: Variational Method for the Analysis of Microstrip Lines, pp. 251 through 255.
Periodical IEEE Transactions on Microwave Theory and Techniques, Aug. 1968, author Eikichi Yamashita, Title: Variational Method for the Analysis of Microstrip–Like Transmission Lines, pp. 529 through 535.
Book Microstrip Antenna Theory and Design, author J. R. James, et al., pp. 54, 55, 230, 231, 238, 239, 248, and 249.
Book Handbook of Microstrip Antennas, vol. 1, edited by J. R. James, et al., pp. 116 and 127.

* cited by examiner

*Primary Examiner*—Don Wong
*Assistant Examiner*—Hoang Nguyen

(57) ABSTRACT

An antenna has a relatively thick primary dielectric between a ground plane and a conducting radiating element being fed by a conducting transmission line, first and second thin dielectrics on opposite sides of the primary dielectric, the relatively thick primary dielectric having a relatively lower dielectric constant than that of at least the second thin dielectric to increase the bandwidth transmission capability of the transmission line for a given impedance, the second thin dielectric couples substantially less power than is coupled with the primary dielectric and the second thin dielectric is of relatively higher dielectric constant promoting surface wave coupling and reduction of wave losses.

9 Claims, 2 Drawing Sheets

Fig. 1
PRIOR ART
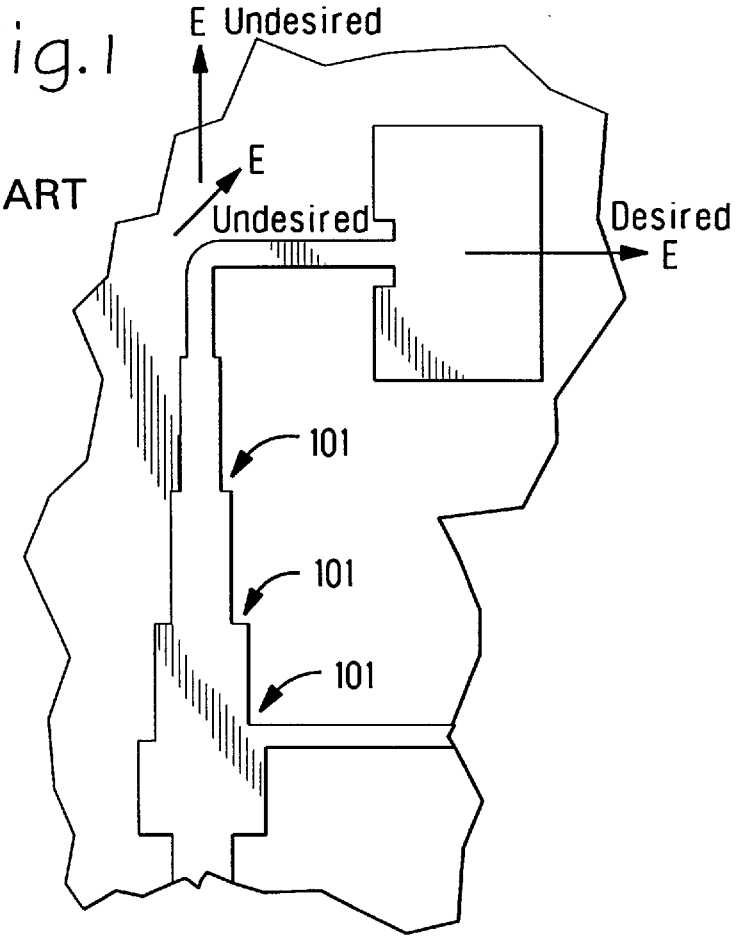
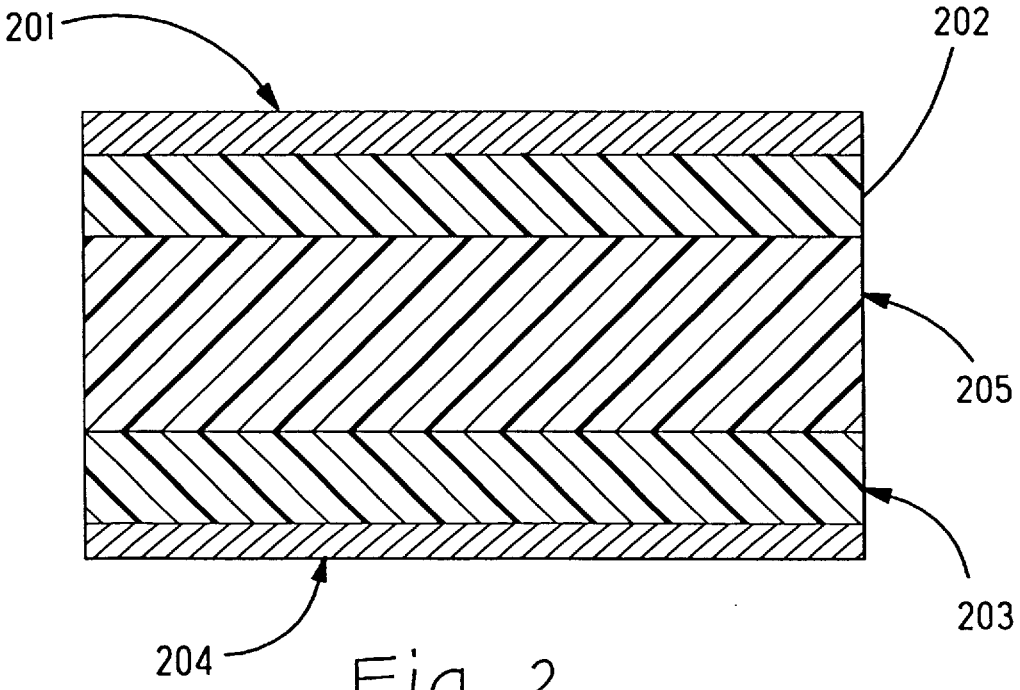
Fig. 2

LOW COST REDUCED-LOSS PRINTED PATCH PLANAR ARRAY ANTENNA

"This application claims the benefit of U.S. Provisional Application(s) No(s). 60/022,621, Filed Jul. 26, 1996."

FIELD OF THE INVENTION

The present invention is drawn to an array antenna for millimeter wave, microwave and rf frequency transmission and reception.

BACKGROUND OF THE INVENTION

In transmission and reception of electromagnetic radiation at rf, microwave, and millimeter wave frequencies, great efforts have been placed on the fabrication of high performance antennas which are manufacturable in high volume production while maintaining a cost which is acceptable in the rf, microwave and millimeter wave industries. One of the major areas in which cost can be checked is in the materials used in the fabrication of the array antenna. To this end, standard practice has been to use a teflon substrate as the dielectric material for the array antenna, the teflon substrate being disposed between the metal ground plane and the metal array. In such an antenna, a copper array is fabricated on the top surface of the teflon dielectric substrate, while a ground plane also of copper for performance purposes is disposed on the lower surface of the teflon substrate.

An alternative to the use of teflon as the substrate dielectric in array antenna applications is the use of a teflon composite having a glass mesh interspersed in the teflon material. The glass mesh in teflon has the advantage of providing structural stability and strength to the dielectric substrate and resultant array antenna. However, the material is intrinsically nonhomogeneous, and accordingly there are places where the differing dielectric constants of the differing materials result in variations in the impedance of the array antenna elements and transmission lines. Ultimately, particularly at narrow transmission-line widths, there are resulting impedance mismatch problems which have a direct impact on array performance. Accordingly, the teflon-glass composite material has been found to be an unattractive alternative to the teflon substrate in an array antenna.

The primary drawback to the use of teflon and teflon-glass substrates as the dielectric in the array antenna is that these materials are available at a relatively high cost, a cost level that is unacceptable for the wireless industry needs. Accordingly, while teflon and teflon-glass composites exhibit acceptable performance for array antennas in the wireless industry, better performance is desired, as well as a reduced cost of manufacture.

An alternative approach to the use of teflon as the substrate for the array antenna is a material having the trade name TPX, and is manufactured by Matsui Path Tek. The chemical composition of TPX is polymethylpentene or PMP. PMP has the same dielectric constant as teflon, and similar or better loss tangent as teflon. Accordingly, PMP appears to present an attractive alternative in that it is fungible with teflon from a performance standpoint, however, is available at a much lower cost. Both teflon and PMP are relatively low permittivity ($\epsilon$) materials and their use in array antennas as the dielectric substrate enables the reduction of surface wave effects. Surface wave effects, which are readily understood by one of ordinary skill in the art through the analysis of boundary value conditions in electromagnetic theory, result in losses due to energy trapped in the dielectric. As stated, the use of low permittivity ($\epsilon$) dielectric substrates such as teflon and PMP reduce the undesired surface or evanescent wave effects.

Accordingly, PMP has the desirable characteristics of reduced surface wave effects, similar or better loss tangent characteristics as teflon and is available at a substantially reduced cost when compared to teflon. However, one drawback that is presented with the substitution of PMP for teflon as the substrate dielectric for an array antenna is that the standard technique for adhering copper to teflon and the subsequent etching to form the metal pattern of the array antenna will not work when PMP is used as the substrate. Furthermore, while low dielectric constant materials have the attendant benefit of reduction of surface or evanescent wave effects, these materials are susceptible to the ill effects of undesired radiation at feeder discontinuities in the array transmission lines. These feeder discontinuities result in losses due to noncoherant radiation having various polarizations with the overall result that increased antenna losses are realized. The undesired radiation resulting from discontinuities in the feeder line to the individual antenna array patches are shown more clearly in FIG. 1. To this end, at each discontinuity of the exemplary feeder line, undesired radiation which is a direct result of the discontinuities of the transmission line on the low permittivity material, is evident at the discontinuity points as shown. One alternative would be to use a higher dielectric material as the substrate. This could possibly reduce the ill effects of discontinuity radiation loss, however most of the commercially available materials have higher dielectric loss tangent values that would result in unacceptable levels of loss in the antenna.

Accordingly, what is required is a low cost transmission line for an array antenna which has the attendant advantage of reduced surface or evanescent wave effects, and thereby a reduction in losses associated therewith, without the disadvantages of feeder discontinuity losses.

SUMMARY OF THE INVENTION

The present invention relates to a low cost, reduced loss array antenna for use at rf, microwave and millimeter wave frequencies. The present invention has the advantage of high manufacturability at low cost, using the desired materials of copper as the array material as well as the ground plane. The array is readily manufactured by the use of an adhesive material which bonds the copper to the PMP in large scale. The material used as the adhesive not only provides a reliable bonding of the copper to the PMP, but also provides a relatively thin layer of high dielectric constant material which has performance advantages described herein. First of all, the PMP material as the dielectric substrate enables manufacture of a low cost array antenna when compared to other materials of low permittivity, for example teflon. The material is homogeneous, so it does not suffer from the ill advantages of localized impedance discontinuities. Furthermore, the use of the low permittivity materials enables the reduction of surface wave effects as is described above. Additionally, the adhesive material having a higher dielectric constant results in a transmission line which reduces feeder discontinuity radiation at the discontinuities of the feeder line on the individual patches of the array antenna. The electromagnetic radiation which normally would have been dissipated at the discontinuity is reduced by the high dielectric material adhesive and while the remainder ultimately is radiated at the patch. This follows from analysis of boundary value conditions of electromagnetic radiation traveling in a waveguide. The resultant PMP-based product is a low cost array antenna having gain characteristics which are higher when compared to an identical array with multiple discountinuities, constructed upon other low permittivity material that are typically used as the dielectric substrate alone.

OBJECTS, FEATURES, AND ADVANTAGES

It is an object of the present invention to have a reduced loss array antenna for use in the wireless industries particularly at microwave and millimeter wave frequencies.

It is a feature of the present invention to have an array of antenna patches on a top surface, a ground plane on a bottom surface, and a dielectric substrate having a dielectric material of a first dielectric constant, sandwiched between two layers of dielectric material having a second dielectric constant, the second dielectric constant being greater than the dielectric constant of the first material.

It is an advantage of the present invention to have an array antenna having reduced surface wave effects as well as a reduction in feeder discontinuity losses.

It is a further advantage of the present invention to have an array antenna for the wireless industry manufactured at a reduced cost.

BRIEF DESCRIPTION OF THE DRAWINGS

FIG. 1 is a top view of a conventional feeder line to a patch antenna of the array of the present invention.

FIG. 2 is a cross sectional view of the present invention having the PMP material sandwiched between adhesive material of a higher dielectric constant than the PMP and with the array antenna and ground plane adhered to the adhesive material layers.

DETAILED DESCRIPTION OF THE INVENTION

Figure 3:
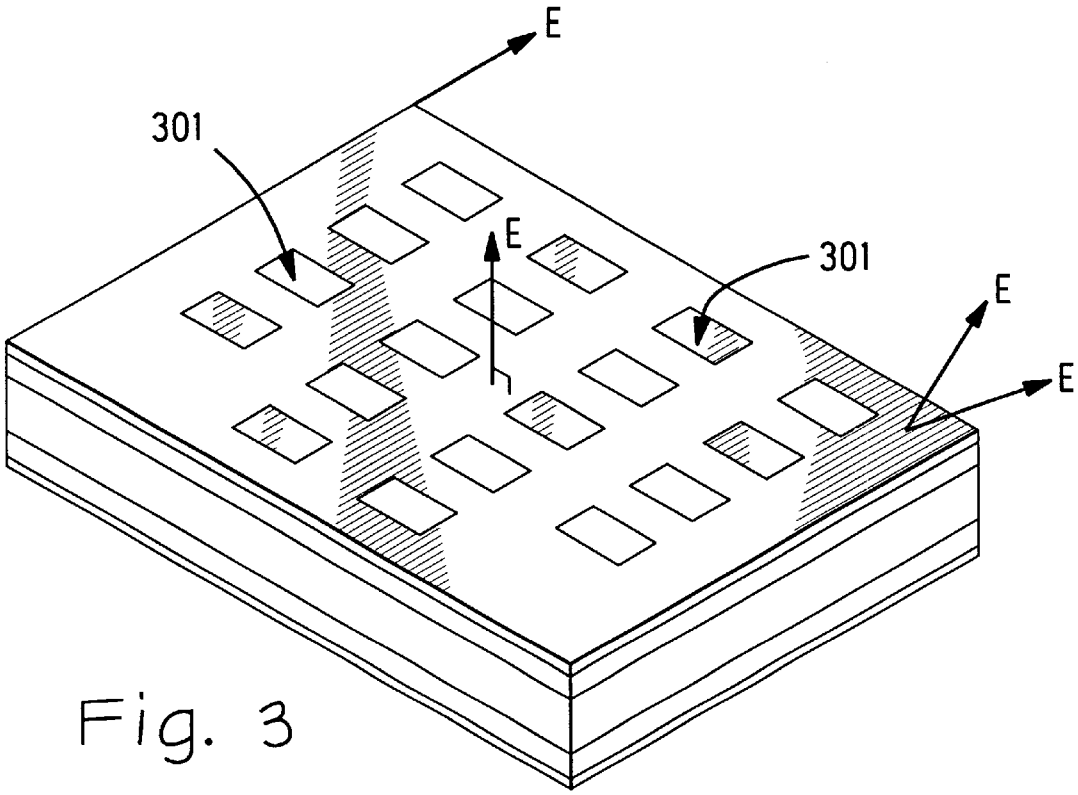
FIG. 3 shows a cross-sectional view of the antenna array of the present invention showing the desired and undesired E-field vectors.

Turning to FIG. 2, a cross sectional view of the waveguide is shown with the etched copper patch array and feeder network therefore shown at 201 disposed on the layer of adhesive 202 with a ground plane 204 with a layer of adhesive disposed at 203 as shown. The PMP material 205 forms the substantial substrate. The material PMP 205 has a preferred dielectric constant, $\epsilon$, of 2.1. While PMP is the preferred material, clearly other dielectric materials are suitable in this role for example, polyphylene oxide, polypropylene, polystyrene, polyolefin, polyethylene, polychlortri-fluorethylene. The critical factor is the homogeneous nature of the dielectric and a dielectric constant having a range on the order of 1–3. The adhesive material is used to adhere the copper to the top and bottom surfaces as shown at 201 and 204. This adhesive material bonds the copper 201 and 204 to the dielectric PMP material 205. The preferred material is Z-flex Freefilm Adhesive manufactured by Courtaulds Performance Films. This adhesive has a dielectric constant greater than the dielectric material 205, on the order of 2.9. Thereafter, the copper layer 201 is selectively etched in order to form the feeder network as well as the patch array for the antenna array structure. This is done by standard photolithographic etching techniques. The dielectric PMP layer has a thickness on the order of 5–20 mils, while the adhesive layers 202, 203 have a thickness on the order of 0.5 mils. Finally, the copper layers 201 and 204 have a thickness on the order of 0.0001 to 0.0007 inches depending on the signal frequency of the application.

Another aspect of the present invention is the ability to increase the bandwidth capabilities of the transmission line because of the use of the lower dielectric material, PMP. To this end, were the layer of dielectric between the transmission line on the top surface, the patch array and feeder network, and the ground plane all of a higher dielectric constant material, the losses would be greater. To this end, for a given impedance line value, the greater the dielectric constant of the dielectric substrate material, the narrower the line width of the transmission lines must be. This translates into a greater resistance, with the narrower line widths, resulting in greater losses. On the other hand, for a given impedance value, a lower dielectric constant material will enable the use of wider transmission lines. Accordingly, the resistance value of the stripline or microstrip line is lower and the power dissipation loss is lower accordingly. The reason for this is the fact that there is a lower dielectric constant material forming a large portion of the dielectric material between the patch array and feeder network on the top surface and the ground plane on the bottom surface resulting in a composite impedance for the entire dielectric. The greater the width of the transmission line, the lower the impedance, and accordingly a variation in the frequency of the transmitted wave will not result in a substantial variation in the transmission line impedance. That is to say, the variation in frequency of the transmitted wave results in roughly the same impedance value. Contrastingly, relatively narrow lines will result in a slight change in impedance for variation in frequency. This can adversely effect the bandwidth. Accordingly, the present invention has a relatively increased bandwidth due to the wider transmission line capabilities in the feeder network and patch array. It is of great importance in the manufacturing process to have wider transmission lines since they are much less expensive to manufacture when compared to narrower transmission lines. Finally, it is of interest to note that the thicker the dielectric layer, the wider the linewidth of the transmission line.

Returning to FIG. 1, an exemplary feeder network with a radiation patch at the end thereof is shown. As stated earlier, at each discontinuity, the radiation transmitted down the transmission line, a microstrip line in most applications, experiences losses at each discontinuity due to undesired radiation dissipated at each discontinuity 101.

Figure 4:
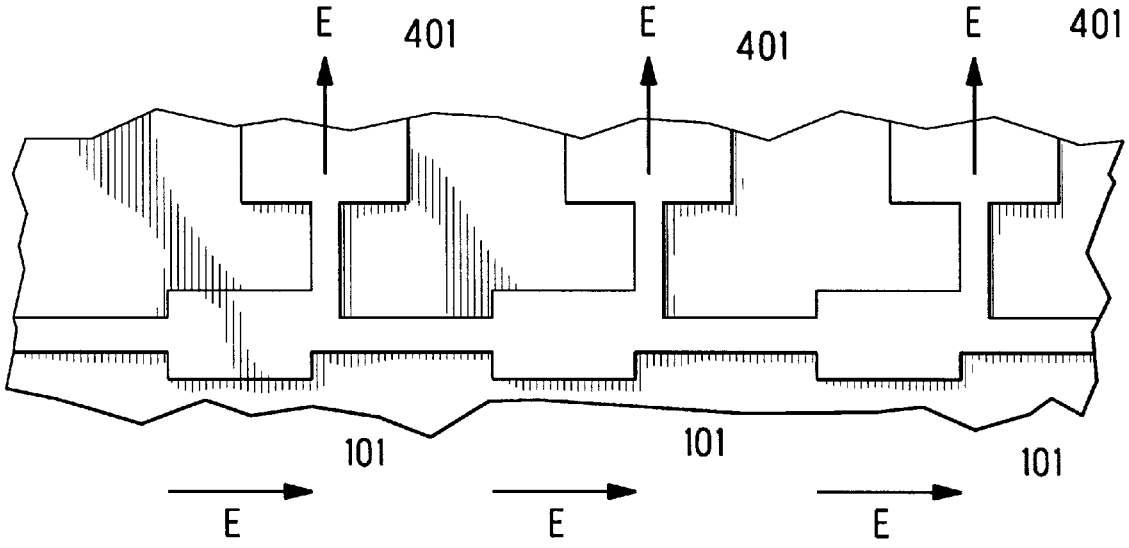
FIG. 4 shows multiple patches/feeders of the antenna array.

Turning to FIGS. 3 and 4, and notwithstanding the changes embodied in the present invention, the discontinuities in the various portions of the stripline or microstripline of the antenna array result in undesired radiation. To this end, the feeder line and patch shown in FIG. 1 is one portion of what constitutes a larger array shown in a larger sequence in FIG. 4. To this end, patch elements 301, 401 are located on the top surface of the antenna. The discontinuities along the top surface of the antenna array have certain undesired effects if unchecked. The radiating elements are spaced in a manner creating a plane which is perpendicular to the desired radiation direction. The spacing between patches in the array is on the order of one wavelength, tending to effect radiation in a direction parallel to the plane of the array. The resultant radiation at the discontinuities are generally on the order of 60–80 degrees from the normal to the plane of the array. In the antenna array there is a direction of radiation or propagation, which is perpendicular to the plane of the array, and a component of radiation which is parallel to the plane of the array. Within each propagating direction, there is an electric field vector and a magnetic field vector each in their own planes. When the electric field vectors are coincident, they are copolarized and produce side lobes which are susceptible to interference, and thereby reduce gain. When the vectors are perpendicular to one another, they are cross-polarized, making the antenna array again susceptible to interference and thereby reduce gain. Finally, as is more clearly shown in FIG. 1, radiation at the bend leading to the patch is typically at a 45° angle, and thereby results in a vector component again parallel to the plane of the array. In contrast, by virtue of the higher dielectric material of the adhesive which sandwiches the lower dielectric PMP, the evanescent wave of the transmission line at each boundary is not as susceptible to losses at each discontinuity. To this end, as stated above, the evanescent wave is "trapped" as can be readily explained in an analysis of the boundary conditions of a electromagnetic field traversing a dielectric waveguide. The result is a substantially improved transmittance, when compared to an identical patch array with multiple discontinuities and a single material substrate throughout, and thereby no adhesive material with the higher dielectric constant sandwiching the material. A thin high dielectric material does not permit much coupling of surface waves. Further details can be found in *Microsrip Antenna Theory and Design* by J. R. James, P. S. Hall and C. Wood, pages 54, 55, 230, 248 and the *Handbook of Microstrip Antennas*; Volume 1, edited by J. R. James and P. S. Hall, pages 116 and 127, which are incorporated herein by reference. The thin aspect of the high dielectric is maintained by the boundary with the low dielectric material. Surface wave coupling to the thin dielectric is roughly on the order of 1% of the total power available, although it could increase to on the order of approximately 10% of the total power available if the total thickness of the substrate were low dielectric material. This could even be greater if the total thickness of substrate were a high dielectric material. The high dielectric material reduces discontinuity radiation effects. This benefit along with the reduced surface wave coupling increases the transmittance of the transmission line. Such is an attendant benefit of the present invention.

The invention having been described in detail, it is clear that variations and modifications are possible to one of ordinary skill in the art. To the extent that such variations and modifications are within the teaching of the present invention, such are believed to be within the scope of the present invention. To this end, the use of a dielectric material having an inner layer of a lower dielectric having at least an outer layer disposed thereabove and a patch array on top of the outer layer, resulting in a reduced cost improved loss patch array antenna for the wireless industry such is deemed to be within the purview of the present invention.

What is claimed is:

1. An antenna comprising:

a first dielectric in a layer between a conducting ground plane and at least one conducting radiating element of an antenna supplied by a conducting transmission line, second and third dielectrics in layers on opposite sides of the first dielectric, at least the second dielectric being relatively thinner than the first dielectric to couple less power than is coupled with the first dielectric, the first dielectric having a relatively lower dielectric constant than that of at least the second dielectric to increase the band width transmission capability of said transmission line for a given transmission line impedance, the relatively thinner second dielectric is adjacent said transmission line and said radiating element, and the relatively thinner second dielectric having a relatively higher dielectric constant than that of the first dielectric to promote surface wave coupling and reduction of wave losses along said transmission line and said radiating element.

2. An antenna as recited in claim 1 wherein, the second and third dielectrics are adhesives that attach the first dielectric to the ground plane and to the transmission line and to said at least one conducting radiating element.

3. An antenna as recited in claim 1, wherein the second and third dielectrics are adhesives that attach the first dielectric to the ground plane and to said transmission line and to said radiating element, respectively, and each of the second and third dielectrics is of substantially uniform dielectric constant.

4. An antenna comprising: a conducting ground plane, a relatively thick first dielectric, at least one conducting radiating element of an antenna being supplied by a conducting transmission line, relatively thin second and third dielelectics respectively between the first dielectric and said radiating element and said transmission line, and between the first dielectric and the ground plane, the relatively thick first dielectric having a relatively lower dielectric constant than that of the second and third dielectrics to increase the band width transmission capability of said transmission line for a given transmission line impedance, each of the second and third dielectrics being relatively thin to couple substantially less power than is coupled with the first dielectric, and at least the second of said dielectrics being of relatively higher dielectric constant promoting surface wave coupling and reduction of wave losses along said transmission line and said radiating element.

5. An antenna as recited in claim 4 wherein, the second and third dielectrics are adhesives that attach the first dielectric to the ground plane and to the transmission line and to said at least one conducting radiating element.

6. An antenna as recited in claim 4, wherein, the second and third dielectrics are adhesives that attach the first dielectric to the ground plane and to the transmission line and to said at least one conducting radiating element, and each of the second and third dielectrics is of substantially uniform dielectric constant.

7. An antenna comprising: a conducting ground plane, a relatively thick first dielectric, at least one conducting radiating element of an antenna fed by a conducting transmission line, a second relatively thin dielectric between the first dielectric and the radiating element and the conducting transmission line, a third relatively thin dielelectric between the first dielectric and the ground plane, the relatively thick first dielectric having a relatively lower dielectric constant than that of at least the second dielectric of relatively higher dielectric constant to increase the band width transmission capability of said transmission line for a given transmission line impedance, the second dielectric being relatively thin to couple substantially less power than is coupled with the primary dielectric, and the relatively thin second dielectric is of relatively higher dielectric constant promoting surface wave coupling and reduction of wave losses along said transmission line and said radiating element.

8. An antenna as recited in claim 7 wherein, the second and third dielectrics are adhesives that attach the first dielectric to the ground plane and to said transmission line and said radiating element.

9. An antenna as recited in claim 7 wherein, the second and third dielectrics are adhesives that attach the first dielectric to the ground plane and to said transmission line and said radiating element, and each of said second and third dielectrics is of substantially uniform dielectric constant.

* * * * *